United States Patent [19]

Megee

[11] 4,018,128

[45] Apr. 19, 1977

[54] PEDAL OPERATOR FOR PIANO AND THE LIKE

[76] Inventor: Robert Luther Megee, 8250 Lankersheim, North Hollywood, Calif. 91605

[22] Filed: Jan. 12, 1976

[21] Appl. No.: 648,263

[52] U.S. Cl. ..... 84/231

[51] Int. Cl.[2] ..... G10C 3/26

[58] Field of Search ..... 84/230–232, 84/358

[56] References Cited

UNITED STATES PATENTS

| | | | |
|---|---|---|---|
| 138,857 | 5/1873 | Class | 84/232 |
| 454,713 | 6/1891 | Class | 84/230 |
| 613,232 | 11/1898 | Bent | 84/230 |
| 743,781 | 11/1903 | Warren | 84/230 |

*Primary Examiner*—Lawrence R. Franklin
*Attorney, Agent, or Firm*—John E. Wagner

[57] ABSTRACT

An attachment for pianos to allow a paraplegic to operate pedals of a piano with his forearms while playing the piano normally. It employs a pivotal arm securable to a keyboard or other convenient location on the piano and includes an operator bar extending along a length of the piano keyboard at approximately the level of the keyboard. The pivotal arm is connected to a push rod while extending downward into the region of the pedals. Attachment means for the rod to operate the sustain pedal is provided.

5 Claims, 6 Drawing Figures

PEDAL OPERATOR FOR PIANO AND THE LIKE

BACKGROUND OF THE INVENTION

Through the years, the development of hand operated controls for various appliances including automobiles have occurred for paraplegics. Typical of the developments of this art are shown in U.S. Pat. Nos. 3,850,048; 3,192,794 and 3,065,647. Other apparatus likewise have been modified to allow use by paraplegics.

One device which is particularly desirable for use by paraplegics is the piano since it requires principally hand action. To this date, to the knowledge of the applicant, no one, however, has ever developed an attachment which would allow a paraplegic to operate the sustain pedal of the piano. Being unable to operate the sustain pedal, a paraplegic could not achieve the sustain effect which is essential to any other than elementary playing of the piano.

Sustain operation by use of the hands is not possible in the case of pianos since the hands and fingers are constantly in use, and abnormal hand movements would destroy the beauty of the work being played. Extension attachments to allow a small child to operate the sustain pedal have been developed as illustrated in U.S. Pat. No. 1,812,716.

BRIEF DESCRIPTION OF THE INVENTION

I have discovered that it is possible to develop a forearm operated control so positioned in front of the keyboard and of such length that either of player's forearms may operate the control required.

I have further discovered that by positioning the control arm as indicated, that simple normal wrist action commonly used by pianists can allow movement of the player's forearm into actuating contact with the operator bar without disturbing a finger action or pressure on the keyboard. Thus, the player may play normally.

BRIEF DESCRIPTION OF THE DRAWING

The foregoing brief description of the invention may be more clearly understood from the following detailed description and by reference to the drawing in which.

DETAILED DESCRIPTION OF THE INVENTION

Figure 3:
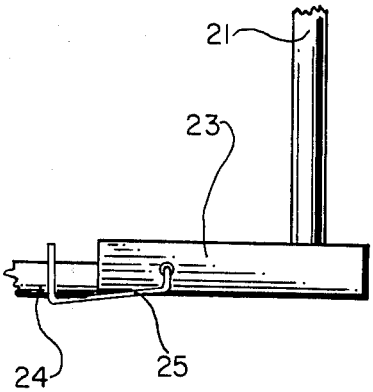
FIG. 3 is a side elevational view of the details of the pedal attachment in accordance with this invention.
Figure 4:
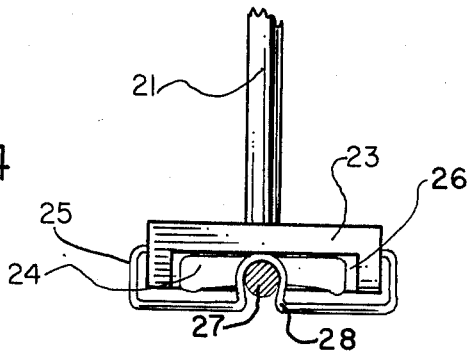
FIG. 4 is a rear elevational view of the pedal attachment of FIG. 3.

Now referring to FIGS. 1 and 2, a sustain pedal operation of this invention is shown as attached to a grand piano 10 at the front of the case and below the keyboard 11. The sustain pedal attachment involves a bracket assembly 12 which is secured to the underside of the keyboard 11 by screws, clamps or other demountable means and rotatably supports a pair of L shaped arms 13 and 14 with their ends terminating in a common operator bar 15 which extends generally parallel to and slightly below the level of the keys 16 and in front of the keyboard 11. The elbow of the L-shaped arms include a pivotal bracket 20 which is secured to a push rod 21 by a thumb screw 22 or similar attachment device. The push rod 21 extends downward and terminates at a pedal foot 23 designed to readily secure to and engage the sustain pedal 24 of the piano 10. The foot 23 is removably secured to the sustain pedal 24 by a spring wire clip 25, the details of which are more clearly seen in FIGS. 3 and 4.

Figure 1:
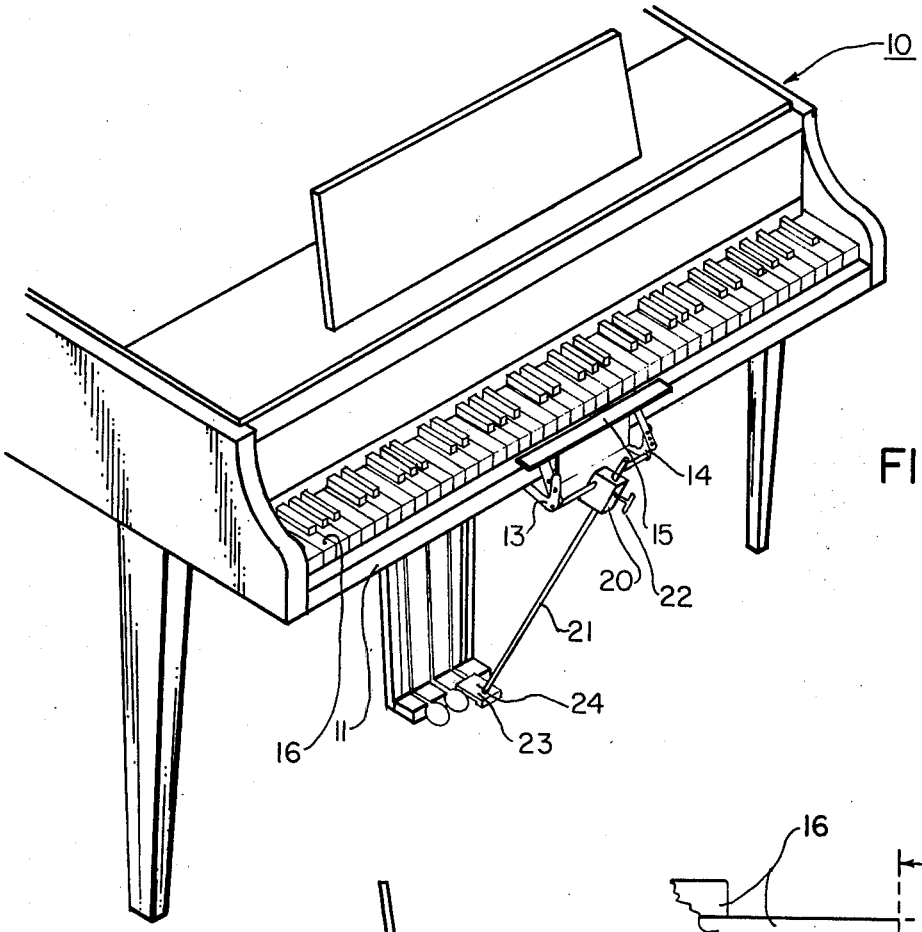
FIG. 1 is a perspective view of a piano incorporating this invention.
Figure 2A:
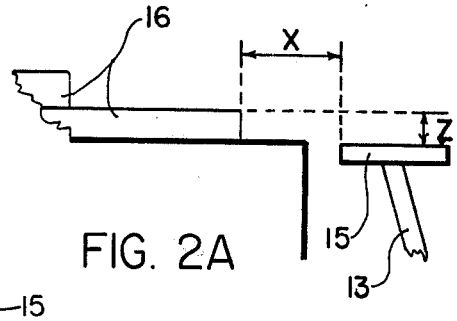
FIG. 2*a* is an enlarged fragmentary view showing of the relationship between the keys and the operator arm of this invention.
Figure 2:
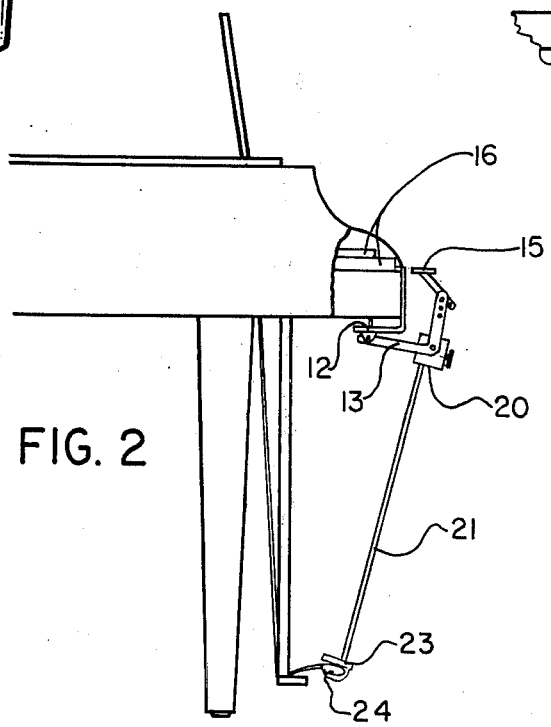
FIG. 2 is a side elevational view of the apparatus of this invention.

Now referring specifically to FIG. 2 in conjunction with FIG. 1, the relative positioning of the operator bar 15 and the L shaped arms 13 and 14 is clearly visible in FIG. 2 as well as the relative position with respect to the keys 16. The operator bar 15 is displaced vertically and laterally with respect to the surface of the keys 16 in front of the keyboard 11 in a position whereby it may be operated by the forearm of the player without any change in the position or pressure of the fingers on the keys. The range and optimum dimensions which I have found are:

| DISTANCE | MINIMUM | MAXIMUM | OPTIMUM |
|---|---|---|---|
| X | 0" | 8" | 3" |
| Y | 25" | 37" | 25" |
| Z | 1" below keys | 2.5" above keys | 1" above keys |

for effective operation with no interference with the operator's playing. When so dimensioned and located, the bar 15 is easily contacted by the underside of the forearm or wrist of the player while playing normally.

The operator bar 15 is preferably on the order of 11 inches long whereby it may be operated by the player's left or right forearm at any time, depending upon which arm is convenient to the middle registers. This is particularly apparent in FIG. 5 in which the player is indicated by the oval shape, and the normal range of movement of both arms is illustrated by the angular regions A and B for the right and left arms, respectively. It should be noted that the bar 15 allows operation by the right forarm alone over the entire keyboard range above the key of G below middle C to last dampered note in treble. Operation above that level is not required in as much as the keys above that level are not normally connected to the sustain pedal.

Figure 5:
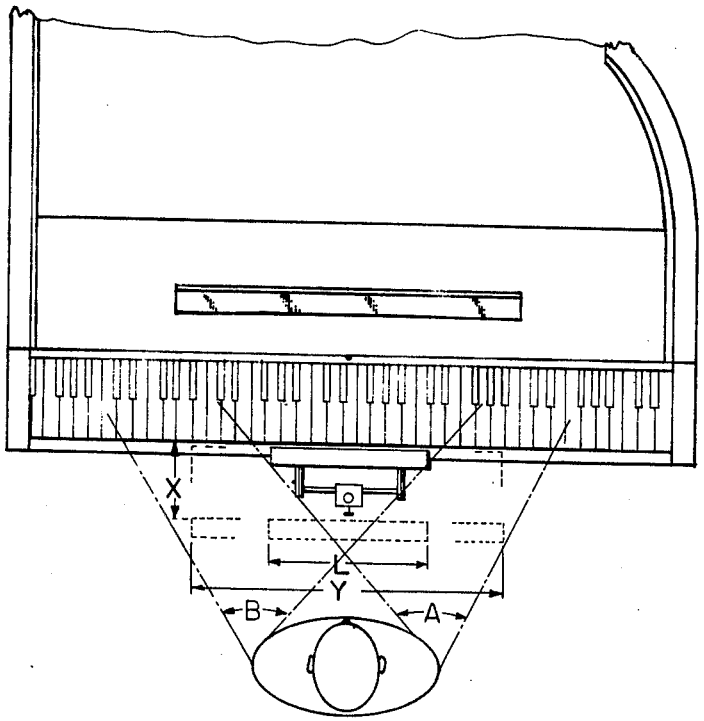
FIG. 5 is a plan view of a piano with the device as mentioned attached, illustrating the range of operation by the players hands shown in phantom.

As show in FIG. 5, Y is the maximum lateral displacement of the operator mechanism allowable for either left or right hand use. The length of rod 21 is determined by this distance and the actual distance between the pedals and the keyboard of the particular piano.

The rod 21 and foot 23 of this invention are secured to the pedal 24 by means of a spring retaining clip 28 which securely holds the foot 23 to the pedal. The foot 23 includes a recess 26 into which the pedal 24 fits extending out of the front of the recess 26. The rear of the recess 26 is closed. Clip 28 is pivotally mounted to allow it to be raised for the insertion of the pedal 24 into the recess 26. The clip 28 is then rotated downward until its throat portion opens and the clip snaps over the stem portion 27 of the pedal 24.

In normal use, the pressure of the player's forarm on bar 15, as applied through bracket 20, push rod 21 and foot 23 acts to depress the pedal 24. The pedal's own return spring provides return force for the pedal 24 and the entire pedal operator of this invention.

The above described embodiments of this invention are merely descriptive of its principles and are not to be considered limiting. The scope of this invention instead shall be determined from the scope of the following claims, including their equivalents.

What is claimed is:

1. An operator for pedals of a piano and the like comprising an elongated bar;

means positioning said bar adjacent to and extending generally parallel to the front of the keyboard of said piano or the like for movement by the forearms or wrists of the player while the player's fingers engage the keys of said keyboard;

means for engaging a pedal of said piano or the like; and means coupling said operator to said engaging means to deflect said pedal upon the movement of said operator.

2. The combination in accordance with claim 1 wherein said positioning means is secured to the keyboard area of the piano for pivotal movement responsive to activation by the player.

3. The combination in accordance with claim 1 wherein said elongated bar is on the order of 11 inches in length whereby it may be engaged by either arm while in normal playing position.

4. The combination in accordance with claim 1 wherein said positioning means is movably mounted with respect to the length of said keyboard to position said elongated bar in front of selected positions of the said keyboard.

5. The combination in accordance with claim 1 wherein said positioning means positions said bar between 0 and 3 inches in front of the keys of said keyboard and between 1 inch below and 2.5 inches above the level of the white keys of the keyboard.

* * * * *